US005774921A

United States Patent [19]

Harrison et al.

[11] Patent Number: 5,774,921

[45] Date of Patent: Jul. 7, 1998

[54] CHILD'S UTENSIL

[75] Inventors: Susan Harrison, Wichita Falls, Tex.; David W. Crossley, Charlestown, R.I.

[73] Assignee: Zooth, Inc., Wichita Falls, Tex.

[21] Appl. No.: 652,855

[22] Filed: May 23, 1996

Related U.S. Application Data

[63] Continuation-in-part of Ser. No. 244,473, Sep. 16, 1994, abandoned, which is a continuation-in-part of Ser. No. 797,029, Nov. 25, 1991, abandoned.

[51] Int. Cl.[6] ..... A46B 5/02

[52] U.S. Cl. ..... 15/145; 15/167.1; 15/176.1; 16/110 R; 7/167; D4/107; D7/651; D7/653

[58] Field of Search ..... 15/167.1, 167.2, 15/143.1, 160, 145, 176.1; D4/104–113, 124–126, 130, 132, 134, 131; D7/651, 656, 657; D21/148; 30/1, 296.1, 298.4, 322, 323, 324, 327; 81/177.85; 16/1 R, 110 R; 7/170, 167

[56] References Cited

U.S. PATENT DOCUMENTS

| | | | |
|---|---|---|---|
| D. 21,560 | 5/1892 | Crowell, Jr. | D7/656 |
| D. 40,122 | 7/1909 | Rogers | D7/656 |
| D. 88,420 | 11/1932 | Kern | D7/656 |
| D. 88,553 | 12/1932 | Hunt | D7/656 |
| D. 127,720 | 6/1941 | Foster | D7/656 |
| D. 128,681 | 8/1941 | Reinold | D7/656 |
| D. 155,668 | 10/1949 | Zanberg et al. | D4/107 |
| D. 155,669 | 10/1949 | Zandberg et al. | D4/107 |
| D. 167,300 | 7/1952 | Brooks | D7/656 |
| D. 209,574 | 12/1967 | Zandberg et al. | D4/107 |
| D. 229,883 | 1/1974 | Pugh, Sr. | D7/651 |
| D. 229,904 | 1/1974 | Cosby | D4/125 |
| D. 237,659 | 11/1975 | Meyer et al. | D4/107 |
| D. 242,507 | 11/1976 | Cohen et al. | D4/125 |
| D. 252,010 | 6/1979 | Manerfield | D7/144 |
| D. 274,971 | 8/1984 | Kelley et al. | D4/107 |
| D. 278,661 | 5/1985 | Grisen | D4/104 |
| D. 294,390 | 2/1988 | Woo | D7/657 |
| D. 294,391 | 2/1988 | Woo | D42/63 |
| D. 329,948 | 10/1992 | Hanner | D4/107 |
| 3,105,612 | 10/1963 | Krasnoff et al. | 222/215 X |
| 3,178,060 | 4/1965 | Bossack | 222/78 X |
| 3,299,891 | 1/1967 | Smeton | 222/78 X |
| 3,968,591 | 7/1976 | Pearson, Jr. | D7/655 |
| 4,389,777 | 6/1983 | Landsberger | 30/324 |
| 4,592,109 | 6/1986 | Borea et al. | 15/144.1 |
| 4,598,437 | 7/1986 | Ernest et al. | 15/145 |
| 4,599,797 | 7/1986 | Bax | 30/323 |
| 4,779,344 | 10/1988 | Panisch | D7/656 |
| 4,780,924 | 11/1988 | Hansen | 15/176.1 |
| 4,961,717 | 10/1990 | Hickey | 446/76 |
| 4,976,646 | 12/1990 | Hull | 222/78 X |
| 4,979,258 | 12/1990 | Buj | 15/167.1 |
| 4,993,156 | 2/1991 | Craven | 30/323 |
| 5,058,230 | 10/1991 | Hodosh et al. | 15/176.1 |
| 5,187,829 | 2/1993 | Atkins | 15/143.1 |
| 5,353,464 | 10/1994 | Atkins et al. | 15/143.1 |
| 5,479,708 | 1/1996 | Thomas | 30/324 |

FOREIGN PATENT DOCUMENTS

| | | | |
|---|---|---|---|
| 3236618 | 4/1984 | Germany . | |
| 8912819 | 3/1990 | Germany . | |
| 2207038 | 1/1989 | United Kingdom . | |
| 03629 | 8/1985 | WIPO . | |
| 10887 | 5/1994 | WIPO | 30/327 |

*Primary Examiner*—Tony G. Soohoo
*Attorney, Agent, or Firm*—Cesari and McKenna, ILP

[57] ABSTRACT

A toothbrush or other utensil specifically designed for use by toddlers and small children provides a handle in the form of an animal figure having a body which is essentially to scale. The handle carries either a rearwardly extending tail or forwardly extending trunk or other singular symmetrical limb. A toothbrush head or other operative utensil portion of somewhat conventional shape is secured to the limb, tail or trunk. The body includes appendages, such as legs, that allow it to stand stably upon a planar surface with the operative utensil portion supported off of the surface. The shaft of the utensil can include a spring-loaded locking member so that it is detachably removable from a base of the handle.

4 Claims, 7 Drawing Sheets

CHILD'S UTENSIL

RELATED APPLICATIONS

This is a continuation-in-part of U.S. patent application Ser. No. 08/244,473 filed Sep. 16, 1994, now abandoned, based upon a U.S. National Designation of PCT Application Ser. No. U.S.92/10067, filed Nov. 20, 1992 and claiming continuation-in-part of status to U.S. patent application Ser. No. 07/797,029, filed Nov. 25, 1991, now Abandoned.

FIELD OF THE INVENTION

This invention relates to a utensil, such as a toothbrush for use by a small child.

BACKGROUND OF THE INVENTION

Stylized and ornamental designs for the handles of utensils and personal grooming aids have remained popular over the years. When these utensils and grooming aids, such as toothbrushes and combs, are intended for small children they often include a decorative or toy-like structure. This structure is desirable since it entertains the child and prompts it to develop favorable associations with the object. In this manner, the child becomes more familiar with the object and is more likely to use it on a regular basis.

In the past, utensils and toothbrushes have included small figurehead designs upon a small portion of the handle or brushhead. While these designs may have entertained the child, they also increased the child's risk of injury. The utensils and their decorative ornamentation often included small shapes that could break off and be swallowed causing choking. The decorative shape, as a whole, may also attract a child to swallow the brush. Since the designs were somewhat small, the child could easily choke upon the brush. Finally, many of the designs, while small enough to become lodged in a child's throat, were too large to fit through a conventional brush holder. Thus, the unsupported brushhead would be prone to contact an unsanitary countertop or similar flat surface, causing soiling of the utensil and/or brushhead.

SUMMARY OF THE INVENTION

It is therefore an object of the present invention to provide a child's utensil, such as a toothbrush, having a decorative shape that is sufficiently large to prevent swallowing of the utensil by a small child.

It is another object of this invention to provide a child's utensil having a decorative handle that may be easily held by a small child.

It is yet another object of this invention to provide a decorative handle or utensil having a decorative handle that includes an integral structure that supports the operative portion of the utensil away from a countertop.

A child's utensil, such as a toothbrush, according to this invention provides a handle in the form of an animal figure having a body which is essentially to scale and is generally cylindrical in configuration so that it may be gripped by a small child. The figure carries either a forwardly extending or rearwardly extending limb that is aligned symmetrically relative to the animal's longitudinal axis and is a limb of a type that is usually singular such as a tail, horn or trunk. The limb is shaped and sized similarly to the neck or handle of a conventional utensil, such as a toothbrush. At the end of this limb is positioned an operative utensil end such as a toothbrush head. The limb should be long enough to allow complete entry of the utensil into the child's mouth but not so long as to allow the child to choke upon the operative end of the utensil. As such, the handle should be large enough in diameter to prevent further entry of the utensil into the child's mouth.

The figure includes a set of legs or similar appendages that are sized and positioned so that when the figure is rested upon its legs on a substantially flat surface, the operative end of the utensil is suspended above the level of the flat surface preventing contact therewith. The utensil can be removable from the animal figure handle. According to another embodiment, the utensil can comprise a handle formed in the shape of a character or other shape. The handle can include a base on a limb feature or other location wherein the base includes an orifice and a channel remote from the orifice. A detachable shaft is provided. This shaft includes a plug member sized and arranged to be inserted fully into the orifice and a hook extending distally from the plug member sized and arranged to pass into the channel. The channel is typically smaller in opening size than the orifice and the hook is typically formed as a curved leaf spring with a protuberance or shoulder adjacent to a free end of the hook. Upon insertion into the channel, the leaf spring must be flexed so that the shoulder exerts a pressure on the channel. The channel is formed with an end wall or other abutment so that the shoulder is moved into engagement with the end wall or other abutment when the hook has passed a predetermined distance through the channel. This predetermined distance is, typically, a distance in which the plug member fully seats in the orifice. The plug member can be provided with a linear side guides that engage corresponding channels in the orifice. The hook and other portions of the shaft can be constructed from a flexible polymer or another similar material having elastic qualities.

BRIEF DESCRIPTION OF THE DRAWINGS

The foregoing and other objects and advantages of this invention will become clear with reference to the following detailed description of the preferred embodiments and brief description of the drawings in which.

DETAILED DESCRIPTION

Figure 1:
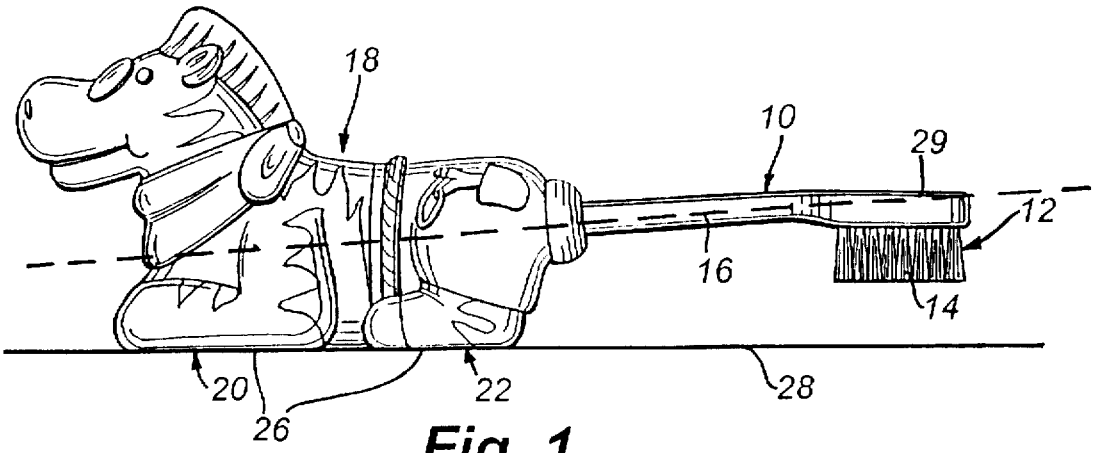
FIG. 1 is an elevational side view of a child's toothbrush according to one embodiment of this invention.
Figure 2:
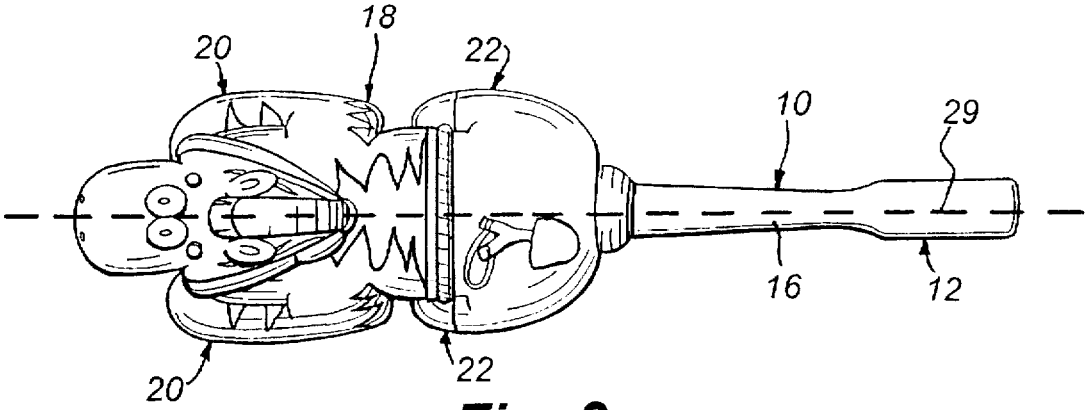
FIG. 2 is a top view of the child's toothbrush of FIG. 1.
Figure 3:
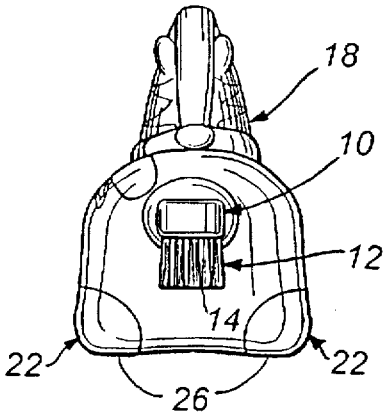
FIG. 3 is a rear view of the child's toothbrush of FIG. 1.

FIGS. 1–3 illustrate various views of a child's toothbrush according to this invention. While the following description relates specifically to a toothbrush, as will be described further below, a variety of other utensils can be adapted for use with the figure handle according to this invention. The toothbrush 10 includes a brushhead 12 of substantially conventional design. The head 12 may be sized so that it fits easily within a small child's mouth. The bristles 14 may be specifically adapted to the needs of small children's and toddler's teeth and, thus, may be smaller and softer than the bristles of adult toothbrushes. The head 12 of the toothbrush 10 is attached to a somewhat conventional narrow and elongated neck 16 having a length sufficient to extend out of child's mouth when the brushhead 12 is positioned relative to the child's deepest teeth. In this manner, the toothbrush 10 may be inserted into the mouth to reach all of the child's teeth.

Figure 18:
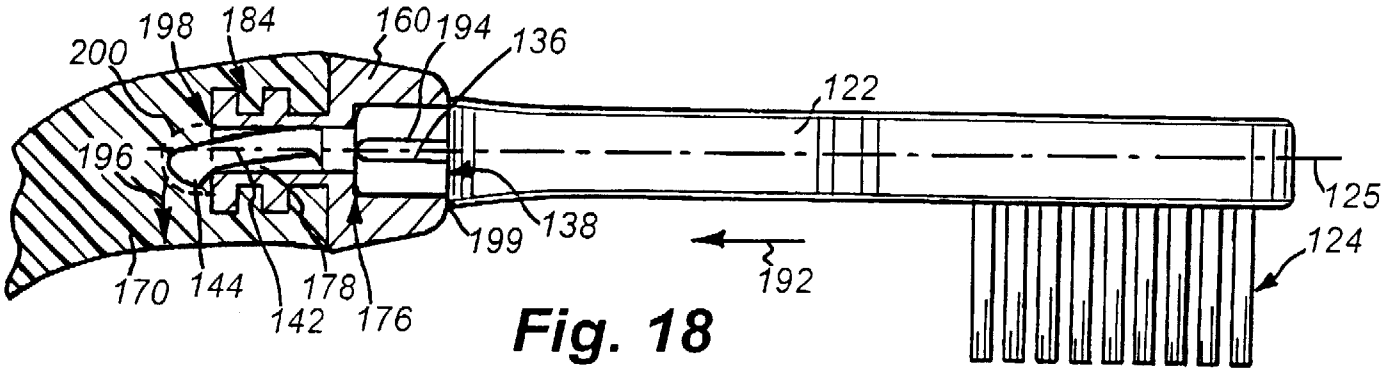

Unlike prior art designs, the end of the elongated neck 16 opposite the head 12 terminates in a large stylized FIG. 18 that acts as a gripping handle for the child to hold while brushing. The FIG. 18 may be molded integrally with or otherwise fastened to the elongated neck 16 and brushhead 12. The overall toothbrush according to this invention, therefore, comprises a brushhead, rod-like neck that is sized to allow the head to enter the child's mouth, and an enlarged handle in the shape of a toy-like figure.

According to this invention, the handle FIG. 18 comprises a decorative animal shape having ornamental clothing. The animal in this embodiment is a horse that, while stylized, is substantially to scale. In other words, the figure includes limbs and other appendages that are not grotesquely mis-proportioned with the remainder of its body. The toothbrush neck 16 comprises the tail of the horse with the brushhead 12 at its tip according to this embodiment. The tail is a natural element for the positioning of a brush according to this invention since it is an appendage that is symmetrical relative to the animal's longitudinal axis and it is singular, unlike the pairs of front and rear legs, 20 and 22 respectively. Due to the axial position of the brush 10, the body of the FIG. 18 may easily serve as a centrally disposed enlarged diameter handle. In addition, the tail of an animal, such as the depicted horse, is usually long, and thus, the elongated tooth brush 10 does not depart substantially from the overall scaled appearance of the animal figure according to this embodiment. Hence the tail location provides a natural and desirable position for the brush. As used herein, therefore, appendage locations such as the tail shall be referred to as limbs that are "singular and symmetrically positioned."

As noted above, the animal figure handle 18 according to this invention is sufficiently sized so that it cannot pass into the mouth of the child. In this manner, the toothbrush 10 can only extend into the child's mouth as far as its elongated neck 16, thus largely eliminating the possibility of choking by the child. The handle 18, in addition, includes a somewhat cylindrically proportioned body portion between the figure's head and the brush neck 16 that is sized in length and diameter such that it is easily held by a small child with no sharp protrusions to break free or otherwise cut the child's hands or mouth.

A notable structural feature of the FIG. 18 according to this embodiment is the set of four legs 20, 22 disposed along the bottom of the body. The four legs 20, 22 are located in conventional positions for a four legged animal and are depicted as bent into a crouched pose to retain the handle-like configuration of the figure. The legs 20, 22 are also flattened along their bottoms 26 so that the handle may be rested upon a substantially flat surface such as a countertop.

As depicted in FIG. 1, when the handle 18 rests upon a flat surface 28, the brushhead 12 is positioned so that it is suspended substantially above the flat surface. In this manner, the brush may remain clean and free from contact with a dirty countertop. While the depicted brush 12 is disposed with its bristles 14 facing downwardly relative to the body of the FIG. 18, it is equally possible to dispose the bristles to the side or upwardly. Downward-facing bristles are generally preferred since this allows the brushhead to drain properly. It is desirable primarily that the bristles remain suspended above the flat surface 28 when the FIG. 18 is placed with its legs 20, 22 upon the surface 28.

Since the FIG. 18 generally comprises a large stable four legged platform having substantial weight relative to the neck and brushhead, it resists tilting that would place the brushhead 12 into contact with the surface. Additional weight may be added to the interior of the FIG. 18 if desired, however. As clearly illustrated the legs of the handle shown and described are folded and, otherwise, located in "close proximity" to the body. This proximity is chosen to enable the legs to be gripped by a toddler or small child's hand. In other words, the legs do not impede the grip of the child. In addition, the handle has a generally "cylindrical" shape, broadly defined, such that a hand is wrapped around the majority of the handle (less the head), including the legs. The approximate center axis 29 wig. 1) of the handle (less head) and brush shaft 16 are in alignment with each other, and are approximately parallel to the surface 28. Such a linear alignment of the handle and shaft make utensil easier to use since the shaft projects relatively straight out of the child's gripped hand for accurate placement in the mouth.

Figure 4:
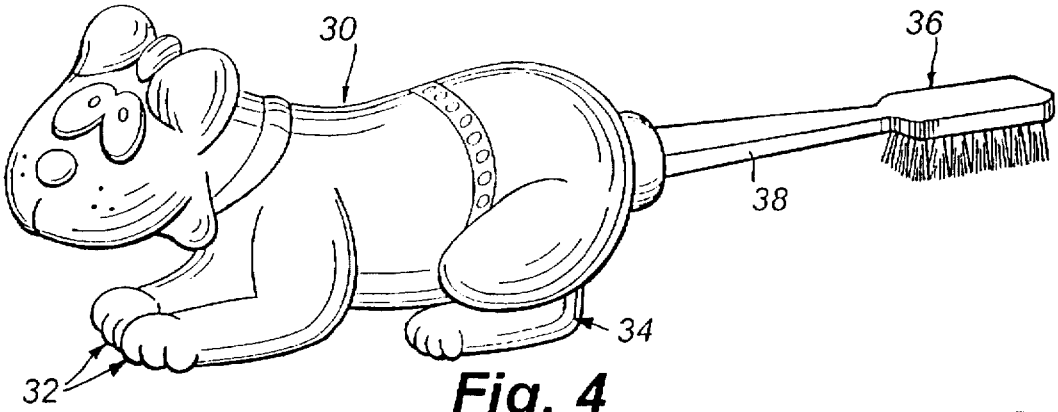
FIG. 4 is a perspective view of another embodiment of a child's toothbrush according to this invention.

An alternative embodiment of a handle figure according to this invention is depicted in FIG. 4. This FIG. 30 represents a stylized dog shape. Like the horse FIG. 18 of FIGS. 1–3 the dog FIG. 30 includes four conventionally positioned bent legs 32, 34 that support the handle FIG. 30 stably upon a flat surface. In this position, the brushhead 36 and brush neck 38, which again comprise the figure's tail, are suspended above the surface. Similarly, the brush of this embodiment comprises a natural appendage or limb (tail) of the animal FIG. 30 that is singular and symmetrically positioned relative to the animal's body.

Figure 5:
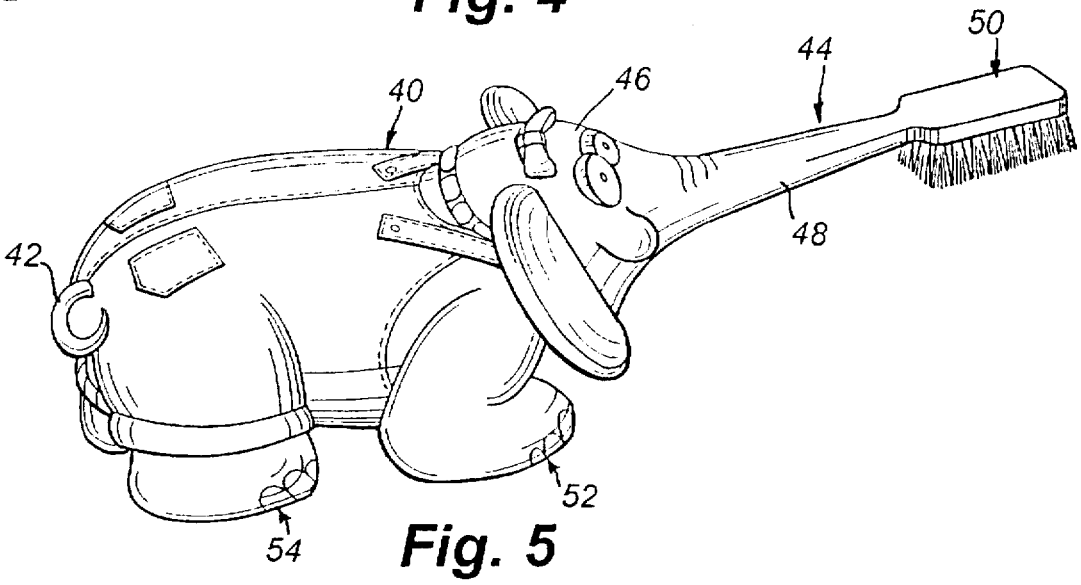
FIG.5 is a perspective view of yet another embodiment of a child's toothbrush according to this invention.

An additional alternative embodiment, depicted in FIG. 5, reveals another possible natural animal appendage that may comprise a toothbrush according to this invention. The animal figure 40 of this embodiment is an elephant. While the figure's tail 42 is a small asymmetric curl exiting the elephant's posterior body, the toothbrush 44 corresponds to the elephant's trunk and exits from its head 46. In this embodiment, the elongated neck 48 of the brush 44 carries a somewhat is trunk-like shape rather than the more conventional square shapes shown for the necks in FIGS. 1–4. The brushhead 50 remains relatively conventional, however. As in other embodiments, the brushhead 50 is suspended above a countertop or other substantially flat surface with the figure's four legs 52, 54 stably engaging the surface. Again, the trunk of the elephant comprises a singular axially symmetrically positioned appendage of the animal that provides a natural point of positioning for the toothbrush 44 according to this invention.

It is important to note that the animal figures depicted herein are contemplated only as exemplary embodiments. The toothbrush may correspond to a central horn on a rhinoceros styled handle, a unicorn styled handle or various dinosaur styled handles. The brush may project outwardly from the figure in axial alignment with the body's longitudinal axis or it may be angled relative thereto (as in a unicorn). Additionally, while the brush neck is often depicted as a conventional squared rod projecting from the figure, it may comprise a shaped animal limb extending out to the brushhead.

Figure 6:
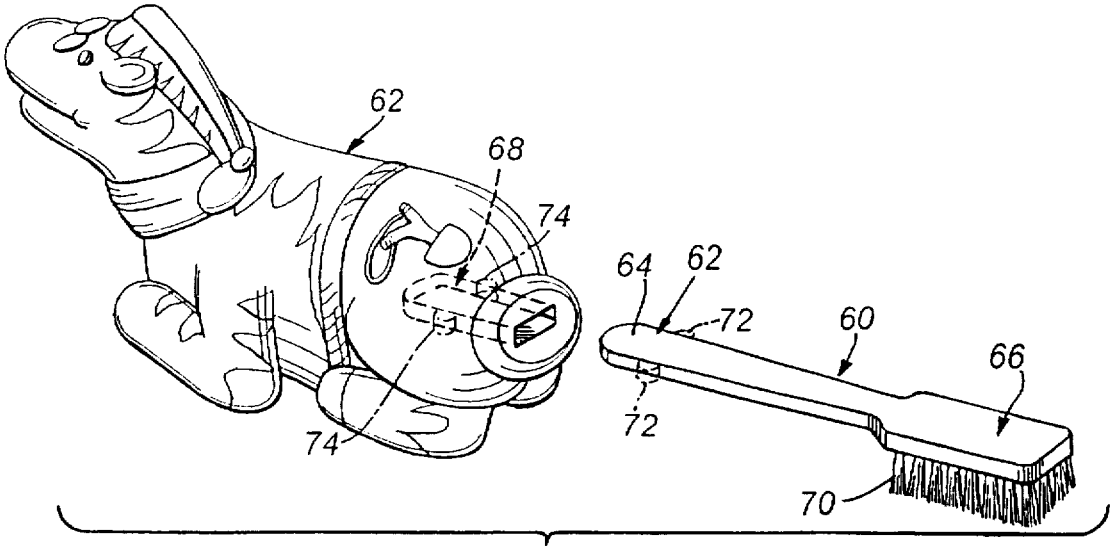
FIG. 6 illustrates a removable toothbrush according to another embodiment of this invention.

FIG. 6 illustrates a child's toothbrush 60 and handle 62 according to an alternative embodiment of this invention. The handle is similar to that described in FIGS. 1–3. While a horse is illustrated, any figure can be utilized according to this embodiment for the handle shape including the elephant figure of FIG. 5 in which the toothbrush extends from the trunk of the elephant. The brush 60 according to this embodiment includes a handle 62 having an end 64 opposite the brushhead 66 that is detachable from the handle 62. A conforming slot 68 is formed in the posterior end of the FIG. 62 in order to receive the handle end 64. In this manner, the handle 62 can be retained when the toothbrush bristles 70 become too worn for further use and the brush is discarded. The user need only purchase a new brush after removing and disposing of the old brush 60.

The brush end 64 according to this embodiment can be held in the slot 68 by a simple press fit or can be more elaborately retained by means of, for example, spring-loaded detents. According to one embodiment, the handle can include nipples 72 (shown in phantom) that are received by the detents 74 (shown in phantom) in the slot 68. Since the handle 62 can be constructed of a somewhat flexible material, the nipples 72 deform during insertion of the handle 62 into the slot 68 and subsequently snap into the detents 74 resulting in a relatively firm interengagement between the brush 60 and handle 62.

Figure 7:
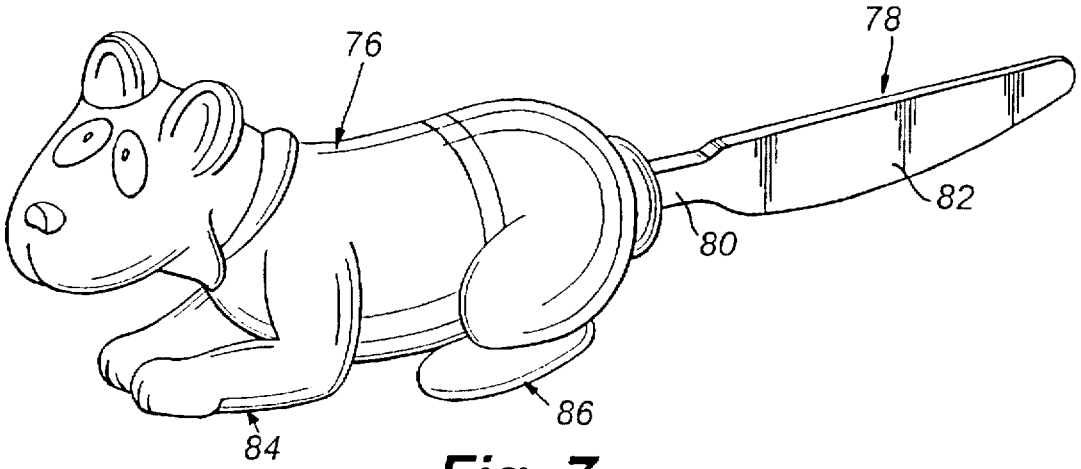
FIG. 7 illustrates a child's knife according to this invention.

As noted above, the handle according to this invention can be adapted to support a variety of other utensils or "utensil elements" commonly employed by children. The familiar figures utilized as handles according to this invention taught in gaining the child's acceptance of the utensil. Thus, in training children to use knives, forks, and spoons, as well as other household utensils such as combs and hairbrushes, it can be desirable to provide a welcoming shape. Accordingly, FIG. 7 illustrates a FIG. 76 having a tail that comprises a utensil element in the form of a table knife 78. The knife 78 is essentially to scale in width, length and thickness with a normal tail of the animal FIG. 76. The knife 78 includes a shaft portion 80 extending directly from the posterior end of the animal in the general anatomical location of a tail. The knife widens to a blade portion 82 (the "operative utensil end or portion") used for cutting food. The animal's front and rear feet 84 and 86, respectively, maintain the knife blade 82 off a flat surface such as a table.

Figure 8:
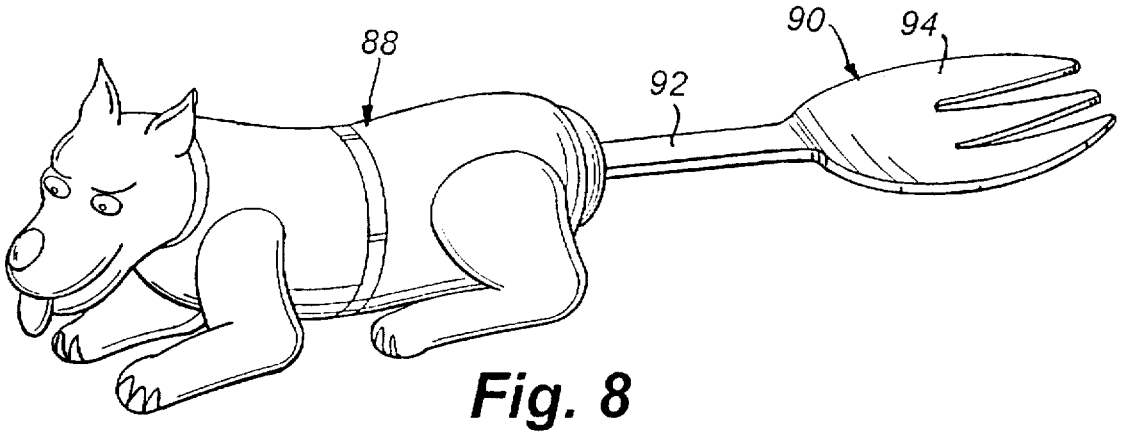
FIG. 8 illustrates a child's fork according to this invention.

FIG. 8 illustrates another animal handle 88 having a fork 90 in the position of the tail. The fork includes a shaft 92 extending from the posterior end of the animal FIG. 88 and also includes a fork end 94. Again, the fork is essentially to scale with a normal tail of the animal and positioned in the same location as a normal tail. The thickness of the shaft 92 is similar to that of a tail. The shaft 92 can be formed as an actual tail shape with only the fork end retaining the functional appearance of a table fork.

Figure 9:
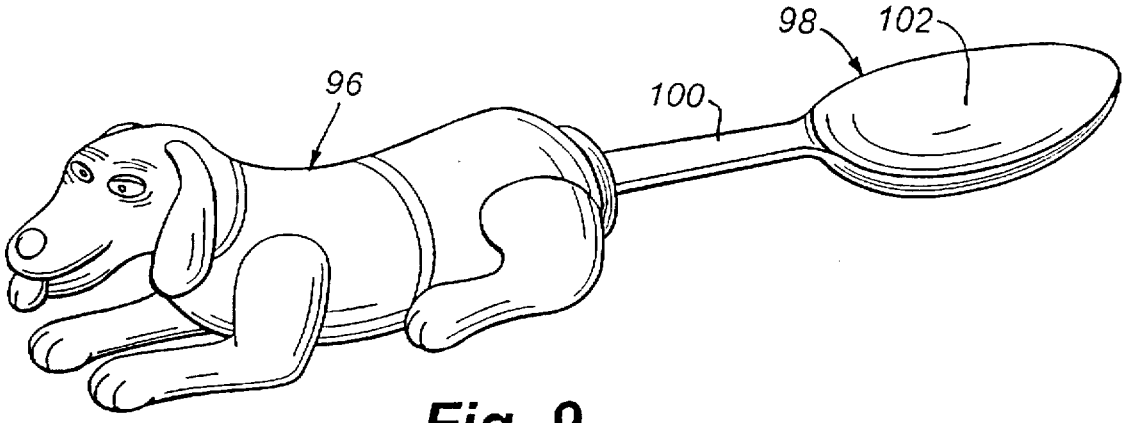
FIG. 9 illustrates a child's spoon according to this invention.

FIG. 9 illustrates a similar animal handle 96 having a tail in the form of a spoon 98. The spoon includes a shaft 100 that, in this embodiment, is somewhat conventional in shape, but can also mirror the shape of a normal tail. The spoon end 102 is of conventional shape and is sized, like the fork, to enter into the mouth of a small child.

In each of the embodiments of FIGS. 8 and 9, the handle 88 and 96, respectively, serves to support the fork 90 and spoon 98 off a flat surface such as a table top. While each utensil element comprises a tail in the above-described embodiment, it can also comprise an elephant trunk or similar head mounted limb or appendage.

Figure 10:
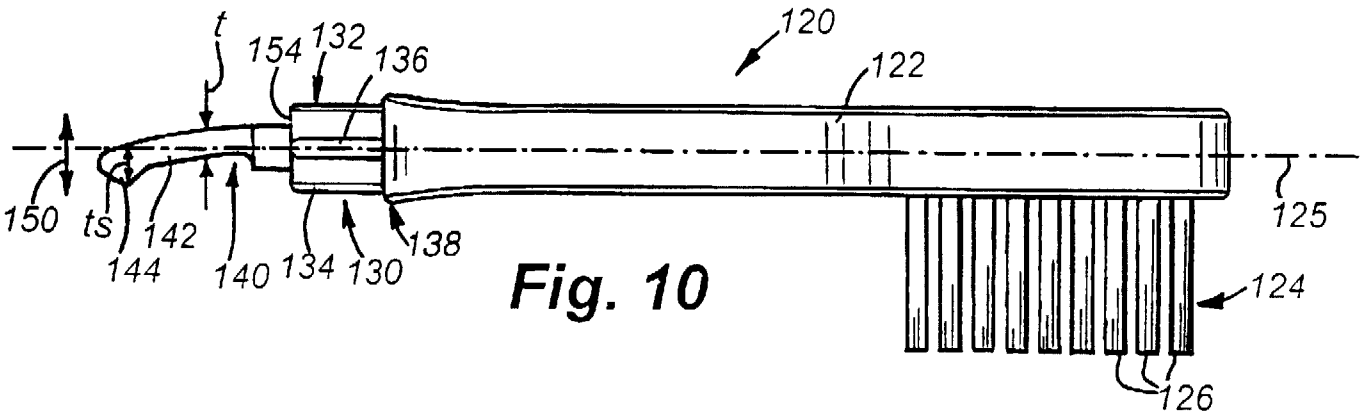
FIG. 10 illustrates a side view of a child's toothbrush having a quick-removal feature according to an alternate embodiment.
Figure 11:
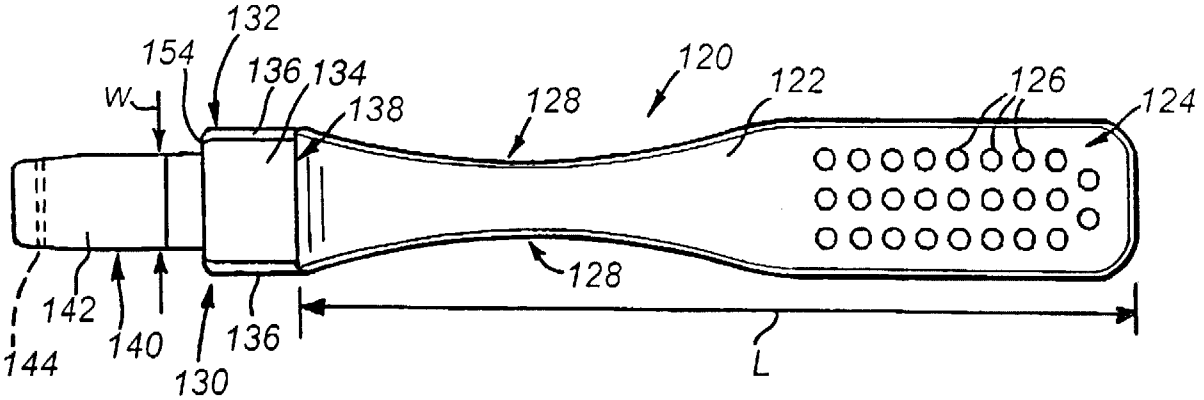
FIG. 11 illustrates a bottom plan view of the toothbrush of FIG. 10.

FIGS. 10 and 11 depict an alternate embodiment of an operative utensil portion 120 ("utensil" herein) that is detachable from a handle. In this embodiment, the utensil 120 comprises a toothbrush having a toothbrush shaft 122 that is substantially straight or "linear" about an axis 125 (FIG. 10). The free end of the shaft 122 includes a brushhead 124 of roughly conventional shape with the series of bristle groupings 126. As depicted, the shaft 122 can include concave recesses 128 (FIG. 11) that enhance the style of the brush and that reduce its mass and occupied space in the child's mouth. The length L of the shaft can be approximately 2¾ inches. As such, the shaft is sized appropriately for the mouth of the toddler or the small child. Note, also, that the shaft 122 is substantially straight along the axis 125 which is advantageous for providing an easily controllable toothbrush that can reach the remote areas of the child's mouth without snagging. It is, however, contemplated that appropriate bends can be provided to the shaft, particularly adjacent to the brushhead 124.

Note that, as used herein, the term "utensil" shall be taken to include any of the above-described utensils, including a spoon, fork, knife, comb or toothbrush. Accordingly, while a toothbrush is depicted in FIGS. 10 and 11, any of the other operative utensil portions described herein can be substituted according to this invention.

The shaft 122 includes, at a remote end 130, opposite the brushhead 124, a shaft base 132 that enables the shaft 122 to be attached and detached from a corresponding handle base. The shaft base 132 includes a male plug member 134 having a pair of raised side guides 136. The plug member 134 has a four-flattened-sided perimeter that is inset (e.g. smaller) than the perimeter of the adjacent edge 138 of the shaft. In this manner the edge 138 of the shaft acts as a stop (to be described further below). Distally of the plug member 134 is located a hook 140 according to this embodiment. The hook 140 is relatively thin (thickness t in side view) and has a substantially larger width (w in plan view). For example, the width w can be between approximately ¼ and ½ inch while the thickness t can be between approximately 1/16and 3/16 inch. The distal portion of the hook 140 defines a curved-shape section 142. At the far end of the curved section 142 is located a protuberance or shoulder 144. As described further below, the substantial difference between the thickness t and width w causes the hook 140 to bend more easily within the plane of the side view (see double arrow 150 in FIG. 10). Bending within the plane of the plan view of FIG. 11 is, conversely, resisted in this embodiment due to the relative width of the curved section. The hook, thus, acts as a leaf spring. The utensil 120, particularly the hook 140, is constructed from a resilient material such as nylon, polystyrene or another flexible plastic. Any acceptable flexible substance can be used for forming the hook. As will be described further below,it is desirable that the hook be constructed so that it can flex approximately 5° (e.g. from a curved orientation into an orientation in which it is aligned with the shaft axis 125) without breaking. The flexure should also be such that the hook 140, when flexed returns to its unflexed, curved shape without substantial plastic deformation. Note that the hook is approximately ½ inch to ⅝ inch in length according to this embodiment taken from the distal end 154 of the plug member 134.

Figure 12:
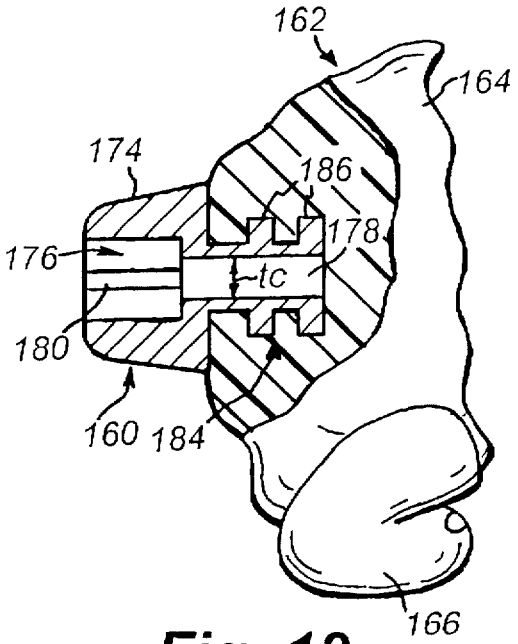
FIG. 12 illustrates a side cross-section of a handle base for use with the toothbrush of FIG. 10.
Figure 13:
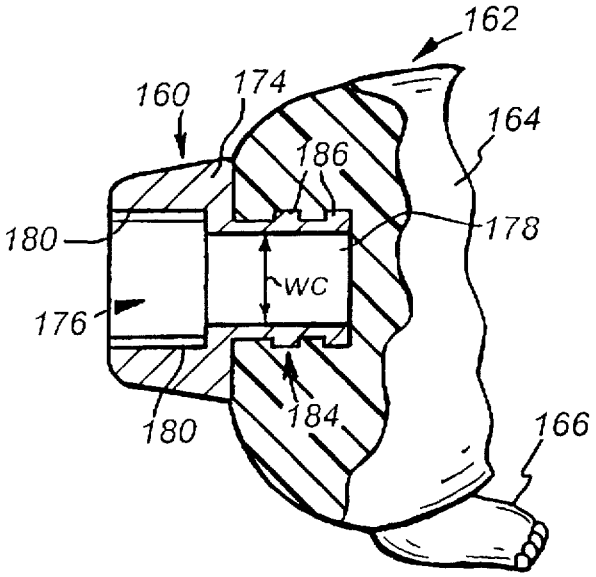
FIG. 13 illustrates a top cross-section of the base of FIG. 12.

With further reference to FIGS. 12, 13, 14 and 15, a handle base 160 is detailed. The handle base 160 is sized and arranged to receive the plug member 134 and hook 140 of the utensil 120 of this embodiment. It is contemplated that the base 160 can be installed in any acceptable handle, with or without a decorative shape as described herein. Similarly, the base can be installed in a power-driven handle, such as an electric toothbrush in some embodiments. As illustrated in FIGS. 12 and 13, the posterior end 162 of an animal-shaped handle 164 carries the base 160 of this embodiment. Note that a rear leg 166 is provided (FIG. 12). This leg 166 can be part of a pair of legs as shown and described herein. A head, body and front leg pair can also be provided. Similarly, the base 160 can be installed in the normal anatomical position of a nose, (trunk or horn) or another limb such as a paw, leg or arm (see arm 170 in FIGS. 16–18 of an animal character handle). By "normal anatomical position" it is meant a location on the body of the animal (including humans) in which a limb would typically be located based upon the type of animal represented by the figure. Accordingly, it is used herein, the term handle, shall be taken to define any shape having a structure upon which the base can be mounted.

Figure 14:
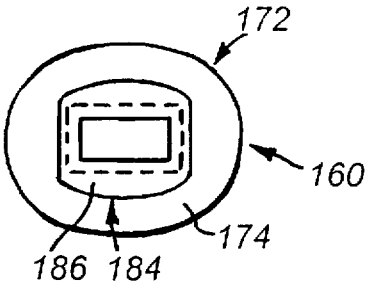
FIG. 14 illustrates a rear view of the base of FIG. 12.
Figure 15:
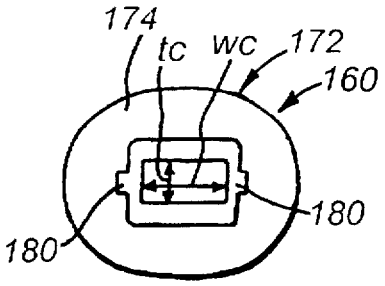
FIG. 15 illustrates a front view of the base of FIG. 12.

The base 106, according to this embodiment defines an oval, outer perimeter 172 (FIGS. 14 and 15). However, other outer perimeter shapes are specifically contemplated. The base 160 includes a raised base structure 174 that projects outwardly from the handle 164. The base structure includes an orifice 176 sized and arranged to receive the plug structure 134 of the shaft 122. Remote from the orifice 176 is located a narrower channel 178 that is, itself, sized and arranged to receive the hook 140 of this embodiment. The channel's width wc and thickness tc are larger than the corresponding thickness t and width w of the hook 140. In particular, the channel width wc can be approximately the same as the width w of the hook, while the thickness tc is slightly larger than the thickness ts (FIG. 10) of the shoulder 144 of the hook allowing the shoulder to pass through the channel.

The orifice 176 further includes side channels 180 that are sized and arranged to accommodate the raised side guides 136 of the plug member 134. These side guides 136 and channels 180 are optional, but they assist in maintaining alignment of the shaft plug member 134 relative to the base 160 as the shaft 122 is driven into the base 160. In addition, the side guides 136 and channels 180 prevent substantial rotation of the shaft 122 relative to the base 160 about the axis 125 during and after attachment of the shaft to the base.

In this embodiment, the base 160 is constructed as a separate member and is press fitted or adhered to the handle 164 using well-known methods. It is also contemplated that the base 160 can be molded as a part of the handle and can have a contour that is continuous relative to the handle. Likewise, the shaft 122 can be formed as an extension of the contours of the handle. For example, as detailed in FIG. 5, the shaft 48 comprises a continuous trunk of the depicted elephant figure up to the point of the brushhead 50. According to the present embodiment, a base, comprising part of the trunk can be provided at a nose location near the eyes of the elephant while the detachable shaft can define a continuation of the trunk with little or no discontinuity between components.

As described above, the base in this embodiment is formed as a separate component relative to the handle. A base extension 184 that defines the inner channel 178 is provided. The base extension 184 is formed as a modified oval (FIG. 14) and includes a pair of peripheral lugs 186 that assists in securing the base into the handle 164. Any acceptable base-handle interengagement structure can be provided and/or the base extension can be lugless, secured to the handle 164 only by a press fit and/or adhesive.

Figure 16:
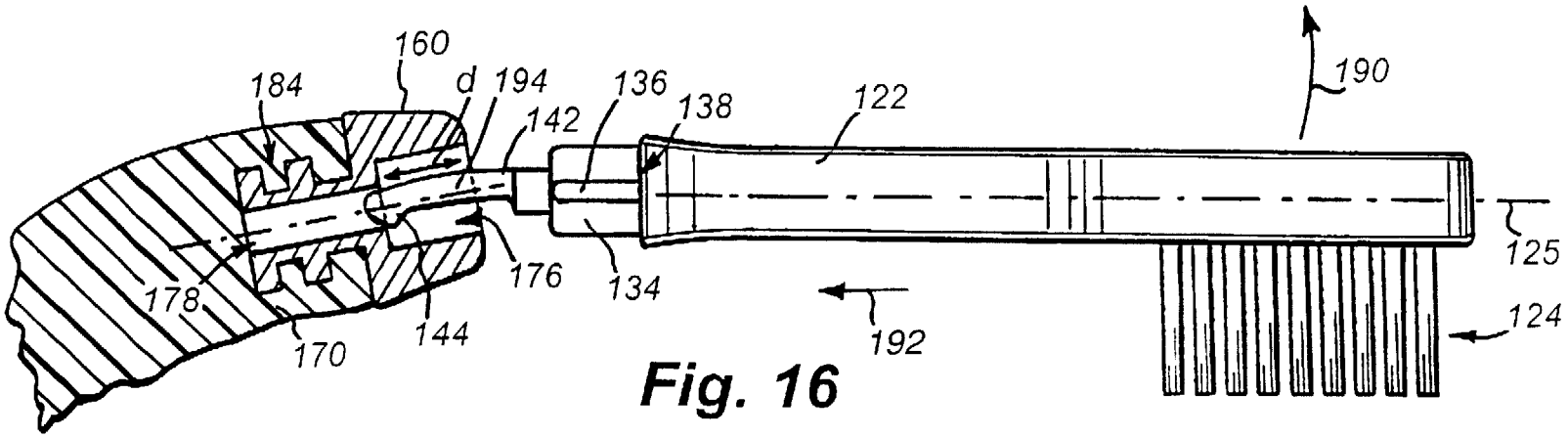
FIGS. 16, 17 and 18 illustrate side views of the process of seating of the toothbrush of FIG. 10 within the base of FIG. 12.
Figure 17:
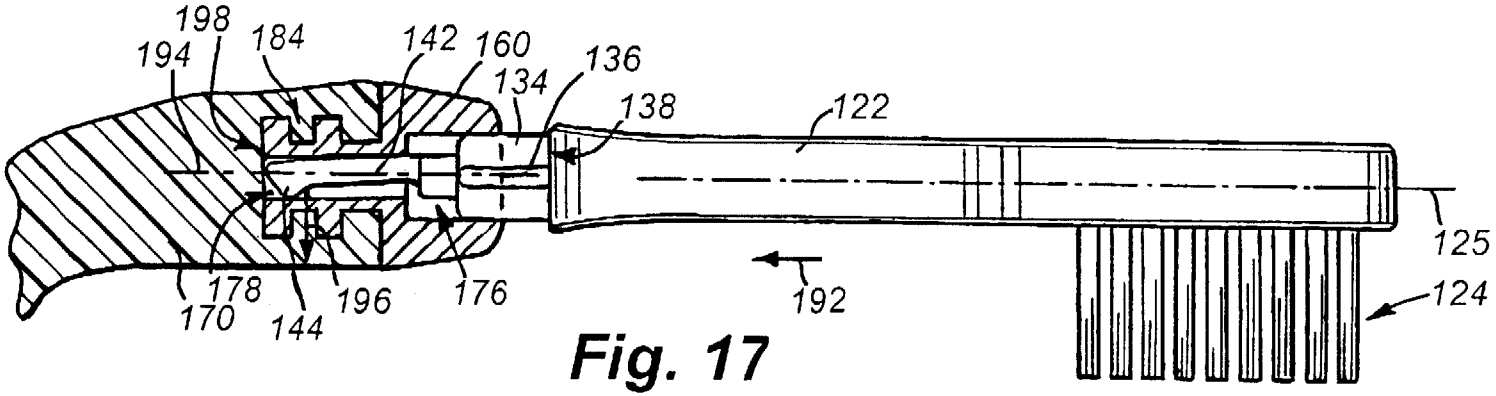

With further reference to FIGS. 16–18, a technique for attaching the shaft 122 of the utensil 120 relative to the base 160 is detailed. As noted above, the base 160, in this embodiment, is attached to a limb 170 such as a paw, leg or arm of a figure. An overall handle body (not shown) having the form of an animal or another figure or character can be provided with the limb 170 acting as an extension of the body of the handle. Note that the detachable shaft of this invention can be attached to a base that forms an extension other than a limb such as an arbitrary projection from a portion of the body, or another object attached to the body like a leg or pedestal.

As detailed in FIG. 16, the shaft 122 is first positioned so that the hook 140 is aligned relative to the channel 178. The shaft 122 is located with its axis non-collinearly relative to the axis 194 of the channel, allowing the curved section 142 of the hook to enter the channel 178 oriented with the widened portion of the hook 140 in alignment with the widened portion of the channel 178. In this orientation, the side guides 136 of the plug member 134 are adjacent with the side channels 180 (not shown in FIG. 16) of the base 160. Once the shoulder 144 engages the channel 178, the shaft 122 is rotated upwardly (arrow 190) as it is driven inwardly (arrow 192) toward the base 160. Note that the hook 140 is longer than the depth d of the orifice 176. Accordingly, the shoulder 144 can become fully engaged within the channel 178 before the plug member 134 reaches the orifice.

As further detailed in FIG. 17, the shaft 122 is aligned so that its axis 125 is collinear with the axis 194 of the channel 178. The hook 140 is now flexed so that the shoulder 144 is biased under spring force (arrow 196) against the lower wall of the channel 178. The plug member 134 is located in engagement with the orifice 176 as the shoulder 144 nears the end wall 198 of the base extension 184.

As finally detailed in FIG. 18, the shaft 122 is driven fully into the base 160 with the shaft shoulder 138 engaging the front wall 199 of the base 160. In this orientation, the hook 140 is driven sufficiently into the channel 178 so that the shoulder 144 extends beyond the end wall 198. The spring force stored in the hook 140 is now relieved, in part, as the shoulder 144 moves downwardly (arrow 196) so that it is positioned in interfering contact with the end wall 198. A hollow region 200 is provided adjacent the end wall 198 to provide clearance for the shoulder 144. It is contemplated that another abutment for engaging the shoulder can be formed within the channel 178 so that no hollow region is required. Likewise, the base 168 can include a hollow region integrally formed at the end of the channel. In this embodiment, the walls of the shoulder 144 are tapered so that a wall having an angle of approximately 20°–60° is presented adjacent the end wall 198. By selecting the angle of the shoulder 144 and the curvature (angular offset relative to the axis 125) of the hook's curved section 142, the amount of holding force imparted by the hook 140 on the base 160 can be varied. The holding force is, in addition, based in part upon the elasticity of the material utilized for the hook 140 and the thickness t of the hook. In the illustrated embodiment, the shaft 122 can be removed from the base upon application of a pulling force in a direction opposite the arrow 192. In an alternate embodiment, the effacing wall of the shoulder 144 can be parallel to the end wall 198. In such an embodiment, a permanent attachment of the shaft 122 relative to the base 160 is obtained.

As noted above, the utensil 120 utilized according to this embodiment can be any one of a variety of hand-held utensils. It is contemplated that a single handle having an assortment of such utensils (e.g. fork, knife, spoon, brush, etc.) can be provided with a single handle end that these utensils can be installed in and removed from the handle at will. Likewise, a number of identical or similar replacement utensils can be provided with a single handle. The resulting product is highly versatile and enables replacement of the operative part without wasting an elaborate handle structure.

It should, therefore, be understood that the foregoing is a detailed description of various preferred embodiments. It should be apparent to those skilled in the art that modifications and equivalents can be made to these embodiments without departing from the spirit or scope of the invention. For example, while a hook having a projecting shoulder is shown the word "shoulder" should be taken to include an indented structure. In such a case the channel would include a projecting "abutment" sized and located to engage the "shoulder" of the hook when the shaft is driven filly into engagement with the handle base. Accordingly, the preceding description is meant to be taken only by way of example and is not meant to limit the scope of the invention.

What is claimed is:

1. A utensil for use by toddlers and small children comprising:

a handle defining an animal figure having front and rear legs for supporting the body on a flat surface, at least some of the legs having flattened portions for engaging the flat surface and at least some of the legs being positioned relative to the body so that a gripping hand of a toddler or small child can grip around the legs;

an orifice positioned at a posterior portion of the body at a location simulative of a tail of the animal figure, the orifice being defined by an orifice opening perimeter;

a channel located adjacent the orifice, remote from the orifice opening perimeter in an inward direction relative to the body, the channel having a channel opening perimeter that is smaller than the orifice opening perimeter of the orifice opening perimeter;

an abutment located in the channel remote from the orifice;

a utensil having a shaft with an operative end and an opposing shaft base end, the shaft base end including a plug member having an outer perimeter sized and arranged to slideably engage the orifice and having, extending distally of the plug member, a curved hook, the curved hook defining a flexible curved leaf spring section having a shoulder mounted thereon, each of the shoulder and the abutment being sized and arranged so that, when the shaft is located at a predetermined position with the plug member inserted into the orifice, the shoulder is located in pressureable engagement, under force of the leaf spring, with the abutment; and wherein the orifice is arranged on the body so that, when the body is supported with the flattened portions of the legs in engagement with the flat surface, the operative end of the utensil is located remote from the flat surface, and wherein the shoulder includes a curved facing surface in engagement with the abutment constructed and arranged so that the force of the leaf spring is overcome and the shoulder is released from pressureable engagement with the abutment upon application of a predetermined releasing force applied to the shaft and against the orifice in a direction opposite the inward direction.

2. The utensil as set forth in claim 1 wherein the orifice includes linear channels located approximately between the channel and the orifice opening perimeter, the linear channels being constructed and arranged to receive corresponding side guides that project from sides of the plug member.

3. The utensil as set forth in claim 2, wherein the plug member includes a perimeter having four flattened sides, the side guides being located on two opposing of the flattened sides.

4. The utensil as set forth in claim 1 wherein the operative end includes a toothbrush head.

* * * * *